US011446839B2

(12) United States Patent
Rochet et al.

(10) Patent No.: US 11,446,839 B2
(45) Date of Patent: Sep. 20, 2022

(54) PROCESS USING POROUS SUPPORTS AND VACUUM HOLD DOWN DEVICE USING SAID SUPPORTS

(71) Applicant: SOFRADIM PRODUCTION SAS, Trevoux (FR)

(72) Inventors: Stephane Rochet, Reyrieux (FR); Thomas Vial, Villefranche-sur-Saone (FR)

(73) Assignee: SOFRADIM PRODUCTION, Trevoux (FR)

( * ) Notice: Subject to any disclaimer, the term of this patent is extended or adjusted under 35 U.S.C. 154(b) by 0 days.

(21) Appl. No.: 16/892,256

(22) Filed: Jun. 3, 2020

(65) Prior Publication Data

US 2020/0316804 A1 Oct. 8, 2020

Related U.S. Application Data

(62) Division of application No. 14/620,316, filed on Feb. 12, 2015, now Pat. No. 10,807,265.

(30) Foreign Application Priority Data

Mar. 20, 2014 (EP) ..... 14305391

(51) Int. Cl.
*B26D 7/01* (2006.01)
*B26D 7/20* (2006.01)
(Continued)

(52) U.S. Cl.
CPC ..... *B26D 7/018* (2013.01); *B25B 11/005* (2013.01); *B26D 7/20* (2013.01); *D06H 7/02* (2013.01);
(Continued)

(58) Field of Classification Search
CPC ..... B25B 11/005; B26D 7/018; B26D 7/20; B26F 3/008; D06H 7/02; Y10S 83/941; Y10T 83/748
(Continued)

(56) References Cited

U.S. PATENT DOCUMENTS 2,825,424 A 3/1958 Gross
3,495,492 A 2/1970 Gerber et al.
(Continued)

FOREIGN PATENT DOCUMENTS

NL 1003174 C2 11/1997

OTHER PUBLICATIONS

Communication pursuant to Article 94(3) EPC issued in corresponding EP Application No. 14305391.6 dated Jul. 19, 2019, 5 pages.
(Continued)

*Primary Examiner* — Clark F Dexter
(74) *Attorney, Agent, or Firm* — Weber Rosselli & Cannon LLP

(57) ABSTRACT

The present invention relates to a porous support (20) intended to be removably positioned on a top side (11*b*) of a perforated plate (11) of a table (10) of a vacuum hold down device (1), the perforated plate having a bottom side (11*a*) connected to a vacuum system (13) for producing reduced pressure on the bottom side, wherein the porous support includes a perforated tray (21) provided on one side (21*a*) with outer reliefs (23) and on the other side (21*b*) with a blade penetrable porous structure (22) fixed thereon. The invention further relates to a vacuum hold down device (1) including such a support. The invention also relates to a process for replacing a first porous support by a second porous support in such a device.

19 Claims, 4 Drawing Sheets

(51) Int. Cl.
*D06H 7/02* (2006.01)
*B25B 11/00* (2006.01)

(52) U.S. Cl.
CPC ..... *Y10S 83/941* (2013.01); *Y10T 29/4973* (2015.01); *Y10T 83/748* (2015.04)

(58) Field of Classification Search
USPC ..... 83/451, 941; 96/131, 132; 210/473, 474, 210/489, 650; 269/21
See application file for complete search history.

(56) References Cited

U.S. PATENT DOCUMENTS 3,715,945 A 2/1973 Mochizuki et al.
3,719,113 A 3/1973 Gerber et al.
3,765,289 A 10/1973 Gerber et al.
3,777,604 A 12/1973 Gerber
3,848,327 A 11/1974 Gerber et al.
3,944,403 A 3/1976 Simpson et al.
4,205,835 A 6/1980 Gerber
4,485,712 A 12/1984 Gerber
4,494,433 A 1/1985 Gerber
4,528,878 A 7/1985 Gerber
4,543,862 A 10/1985 Levene et al.
4,656,906 A 4/1987 Mozieka et al.
4,672,870 A 6/1987 Levene et al.
4,768,763 A 9/1988 Gerber
4,828,238 A 5/1989 Mozieka et al.
4,850,579 A 7/1989 Fisher
5,141,212 A 8/1992 Beeding
5,358,226 A 10/1994 Arikita
6,199,686 B1 3/2001 Devine et al.
8,460,421 B2 6/2013 Troxell et al.

OTHER PUBLICATIONS

European Office Action dated Aug. 25, 2016 in corresponding European Patent Application No. 14305391.6, 3 pages.
European Search Report, Application No. 14305391 dated Aug. 25, 2014.

PROCESS USING POROUS SUPPORTS AND VACUUM HOLD DOWN DEVICE USING SAID SUPPORTS

CROSS-REFERENCE TO RELATED APPLICATIONS

This application is a divisional of U.S. patent application Ser. No. 14/620,316 filed Feb. 12, 2015, which claims benefit of and priority to European Patent Application Serial No. 14305391 filed Mar. 20, 2014, the disclosures of each of the above-identified applications are hereby incorporated by reference in their entirety.

BACKGROUND

1. Technical Field

The present invention relates to porous supports and to a vacuum hold down device using such supports, such a vacuum hold down device being useful for example in the cutting of sheet material, such as textiles. The present invention further relates to a process for changing porous supports in a vacuum hold down device.

2. Background of Related Art

When operated, a vacuum hold down device provides for a reduced pressure on the bottom side of a perforated plate. When a sheet of workpiece material to be cut by a cutting device is laid on the top side of the perforated plate, the vacuum draws the sheet of workpiece material down against the plate and holds it in a fixed position despite lateral forces applied to the sheet of workpiece material by the cutting device during the cutting step.

In order to protect the perforated plate as the cutting device cuts through the sheet of workpiece material, vacuum hold down devices are usually provided with a bed of porous material fixed to the top side of the perforated plate. This porous bed provides a supporting surface for the sheet of workpiece material to be cut and is penetrable by the cutting device.

In order to proceed to the cutting step, the sheet of workpiece material is laid on top of the porous bed. A film impervious to the passage of air therethrough is usually put on top of the sheet of workpiece material in order to optimize the efficiency of the vacuum system. The vacuum system is switched on and the cutting device is operated. In use, the cutting device cuts through the film, through the sheet of workpiece material and through the porous bed.

Surgical textiles intended to be implanted in the body of a patient, such as for example meshes for hernia prostheses, are subject to specific sterilization procedures. Contamination in general must be avoided, and in particular contamination coming from other textiles.

In the cutting process described above, it may happen that the porous bed retains bits of the sheet of workpiece material, that are generated by the cutting device for example. Such a phenomenon is problematic when the material is under the form of textile and when the device is used in order to cut successive different textiles which may further be used as meshes for different prostheses. The textiles may indeed be different in nature, color, densities, etc. . . . It is not acceptable that bits of a first textile mix with a second textile, when these first and second textiles are different and are both intended to be used in the manufacture of prostheses.

In existing vacuum hold down devices, the changing of the porous bed is long and fastidious. The porous bed is stuck to the topside of the perforated plate with glue and its removal requires both removing the porous material forming the bed and remaining parts of dried glue. During this operation, the porous bed is damaged and disposed of. Additional time is needed to check that no undesirable bits of porous material and/or of glue remain on the top side of the perforated plate. Afterwards, a new porous bed must be glued to the top side of the perforated plate. These operations are time consuming.

During these maintenance operations, the vacuum hold down device is at a standstill and cannot be used for cutting textiles. As a consequence, the production rate of the final product, such as prostheses for example, is impacted.

There is therefore a need for a vacuum hold down device that would allow the successive cutting of different sheets of workpiece material, such as textiles, with limited risks that bits of a first material be mixed with a second material, and without having to stop the production line for a too long time.

SUMMARY

A first aspect of the present invention is a porous support intended to be removably positioned on a top side of a perforated plate of a table of a vacuum hold down device, said perforated plate having a bottom side connected to a vacuum system for producing reduced pressure on said bottom side, wherein the porous support comprises a perforated tray provided on one side with outer reliefs and on the other side with a blade penetrable porous structure fixed thereon.

According to the present application, by a "porous material" is meant a material having a porosity defined by a plurality of holes, voids, pores, open cells or perforations, on its surface and through its thickness so that airflow from a vacuum system is capable to pass through said material.

Indeed, the porous support of the invention is intended to be used in combination with a vacuum hold down device and its overall porosity, namely the perforations of the perforated tray and the porosity of the porous structure, is configured to allow the airflow from the vacuum system to pass through it.

"Blade penetrable" means according to the present application that the porous structure can be easily cut by a cutting device usually used for cutting sheets of workpiece material such as textile. The cutting device may for example be a blade. The penetrable porous structure is intended to provide support for a sheet of workpiece material to be cut and its porosity should allow the air from the vacuum system to pass therethrough. The penetrable porous structure may be formed of a foam plastic with open cells, like for example a low density cellular polyethylene or polypropylene material.

The perforated tray is configured so as to let the air from the vacuum system pass through it. The perforated tray provides rigidity to the penetrable porous structure so that the resulting porous support may be easily handled and transported during the operations of installing it on the top side of the perforated plate and removing it therefrom. The tray may be made of metal, such as aluminum, stainless steel, or combinations thereof.

The penetrable porous structure is fixed to the perforated tray, for example by gluing, so that the resulting porous support is easily handled.

The perforated tray is provided with outer reliefs on its bottom side intended to face the top side of the perforated plate. In embodiments, the outer reliefs are configured so as to create a space between the top side of the perforated plate and the tray, for allowing passage of the airflow from the vacuum system, when the porous support is positioned on the top side of the perforated plate, with the outer reliefs facing said top side. For example, the outer reliefs may be regularly distributed on the surface of said bottom side of the tray. Alternatively or in combination, the outer reliefs may show a substantially constant height.

In embodiments, the porous support further comprises at least part of releasable fixing means for temporarily fixing the porous support to the top side of the perforated plate. Cooperating part of the releasable fixing means may then be present on the perforated plate.

Another aspect of the invention is a vacuum hold down device comprising:

a table comprising a perforated plate having a bottom side connected to a vacuum system for producing reduced pressure on said bottom side, and at least a porous support as described above.

The device of the invention allows changing porous supports very easily and very quickly. Indeed, in the vacuum hold down device of the invention, the porous support is positioned on the top side of the perforated plate, with the outer reliefs of the perforated tray facing the top side of the perforated plate. The tray may be simply laid on the top side of the perforated plate, with the outer reliefs directly bearing on the perforated plate. The tray needs not be glued to the perforated plate. Its positioning on the perforated plate, as well as its removal from said perforated plate, is therefore facilitated. In order to remove the porous structure, the whole porous support is removed. There is no need to unglue the porous structure from the tray. The porous structure is therefore not damaged when removed, and the time for proceeding to this removal is very short.

In embodiments, the vacuum hold down device comprises a plurality of such porous supports. As the porous supports are configured to be removably positioned on the top side of the perforated plate, each porous support may be easily installed on the perforated plate and as easily removed in order to install another porous support. During these operations, the porous supports are not damaged. They may be used several times. In particular, it is possible to have a porous support dedicated to a specific material to be cut, such as a textile. For example, each time a different textile needs to be cut, the previous installed porous support is removed and another porous support, dedicated to the textile to be cut, is installed.

The vacuum hold down device of the invention allows maintaining the quality of cut textiles, in particular by avoiding that bits of a first textile, originating from a previous cutting step of said first textile, mix with a different, second textile, to be cut.

In addition, because the various porous supports may be easily and quickly installed and/or removed from the top side of the perforated plate, significant time is gained during the maintenance of the device. The production rate of the final product is therefore increased.

In embodiments, the vacuum hold down device further comprises releasable fixing means for temporarily fixing a porous support to the top side of the perforated plate. For example, the perforated tray of the porous support may be provided with screws configured to cooperate with corresponding threaded holes provided in the perforated plate, so as to releasably fix the perforated tray to the perforated plate. In alternative embodiments, the fixing means may be in the form of a clamp.

In embodiments, the vacuum hold down device of the invention comprises a cutting device configured for cutting a sheet of workpiece material intended to be laid on the porous support positioned on the top side of the perforated plate. For example, the cutting device may be a blade or a cutter, supported by a movable carriage capable of traversing the surface of the table in two coordinate directions. Alternatively, the vacuum hold down device may be free of any cutting device and the cutting step may be performed manually by a user holding a cutter or a blade in his hand.

Another aspect of the invention is a process for replacing a first porous support as described above positioned on the perforated plate of a vacuum hold down device as described above by a second porous support as described above, comprising the following steps:

i) removing the first porous support, and ii) positioning the second porous support on the top side of the perforated plate, with the outer reliefs of the perforated tray of said second porous support facing the top side of said perforated plate.

The step of removing the first porous support is easy and may be completed in a limited time, as the tray needs only to be removed from the perforated plate and the porous structure remains fixed to the tray. In addition, for the same reason, the positioning of the second porous support is also easy to perform and may be completed in a limited time.

In embodiments where the device comprises screwing means for temporarily fixing a porous support to the top side of the perforated plate, step i) may comprise unscrewing said first porous support from said perforated plate and step ii) may comprise screwing said second porous support on said perforated plate. In these embodiments also, the time required for unscrewing the first porous support and for screwing the second porous support is significantly less than the time needed for ungluing the porous beds in devices of the prior art.

With the porous support and vacuum hold down device of the invention, significant time is saved in the production of cut textiles and of final products manufactured. The rate of the production line is therefore increased with respect to that obtainable with the devices of the prior art.

BRIEF DESCRIPTION OF THE DRAWINGS

The porous support, vacuum hold down device and process of the invention will now be further described in reference to the following description and attached drawings in which.

DETAILED DESCRIPTION OF EMBODIMENTS

Figure 1:
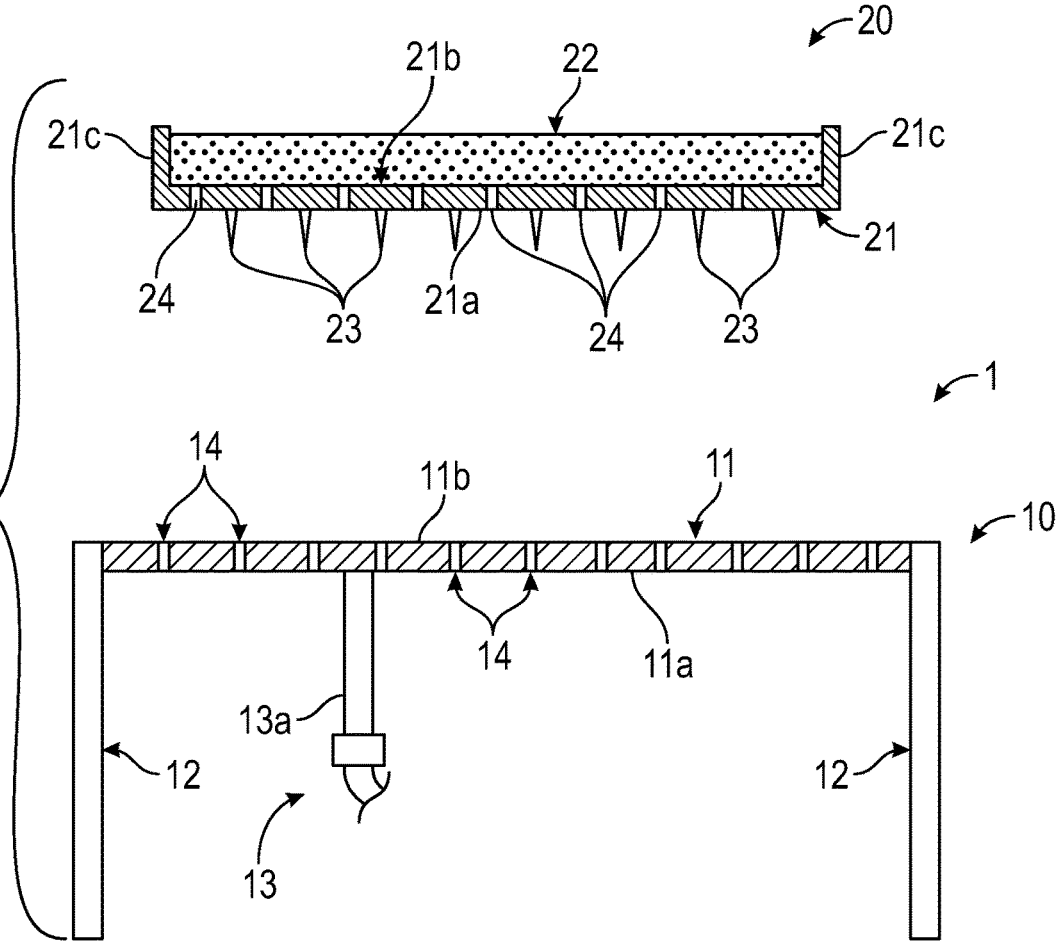
FIG. 1 is an exploded cross section view of an embodiment of a vacuum hold down device of the invention showing a porous support of the invention and a table.

With reference to FIG. 1 is shown in cross section a vacuum hold down device 1 according to the invention, comprising a table 10 and a removably positionable porous support 20. As will appear from the description below and more particularly with further reference to FIG. 7, such a vacuum hold down device 1 may be used in the cutting of a sheet of workpiece material 100, in order to maintain the sheet of workpiece material in a spread configuration and in a fixed position during the cutting process. Anyway, irrespective of the fact that the vacuum hold down device 1 of the invention is illustrated in the present application with reference to a cutting process, it should be kept in mind that the vacuum hold down device of the invention may be used in any situation where it is desirable to maintain a sheet of workpiece material in a spread configuration and in a fixed position.

The table 10 comprises a perforated plate 11 having a generally horizontally rectangular shape supported by four feet 12 (two only being visible on FIG. 1). The perforated plate 11 has a bottom side 11*a* and a top side 11*b*. The bottom side 11*a* is connected to a vacuum system 13. The vacuum system comprises a duct 13*a* linking a suitable vacuum source (not shown) to the bottom side 11*a* of the perforated plate 11. When the vacuum system 13 is switched on, reduced pressure is applied on the bottom side 11*a* of the perforated plate 11.

The perforated plate 11 has a plurality of traversing holes 14 formed therein for passage of the airflow generated by the vacuum system 13 from the top side 11*b* of the plate 11 to its bottom side 11*a*. The perforated plate 11 is made from a material having mechanical properties allowing it to be used as a support for the porous support 20 and sheet of workpiece material 100 (see FIG. 7) intended to be laid on the porous support 20. The perforated plate 11 is for example formed of a metal. Examples of suitable metals for the perforated plate are aluminum, stainless steel and combinations thereof.

Still with reference to FIG. 1, the porous support 20 comprises a perforated tray 21 and a blade penetrable porous structure 22 fixed thereon. The porous support 20 has globally a rectangular shape and is intended to be positioned on the perforated plate 11 and to serve as a supporting surface for the sheet of workpiece material 100 to be cut.

The perforated tray 21 has a bottom side 21*a* and a top side 21*b*. FIG. 3 is a perspective view from the bottom of the perforated tray 21 of FIG. 1 on its own. As clearly shown on this Figure, the bottom side 21*a* of the perforated tray 21 is provided with a plurality of outer reliefs 23. As shown on FIG. 2, the outer reliefs 23 are configured so as to create a space 30 between the top side 11*b* of the perforated plate 11 of the table 10 and the tray 21, once the porous support 20 is positioned on the perforated plate 11, with the outer reliefs 23 facing the top side 11*b* of the perforated plate 11. Such space 30 allows the passage of the airflow generated by the vacuum system 13 from the porous support 20 to the perforated plate 11. The outer reliefs 23 may be distributed regularly or not regularly on the surface of the bottom side 21*a* of the tray 21, and they may show different heights, as long as they create the space mentioned above. Anyway, in embodiments, such as shown on FIG. 3, the outer reliefs 23 are distributed regularly on the surface of the bottom side 21*a* of the tray 21 and they show a substantially constant height.

The perforated tray 21 further comprises a plurality of traversing holes 24 formed therein for passage of the airflow generated by the vacuum system 13 from the top side 21*b* of the tray 21 to its bottom side 21*a*. The perforated tray is made from a material allowing it to show sufficient mechanical properties for being used as a support for the porous structure 22 and sheet of workpiece material 100 intended to be laid on the porous support 20 on one hand, and to be light enough so as to be easily transportable on the other hand. The perforated tray 21 is for example formed of a metal. Examples of suitable metals for the perforated plate are aluminum, stainless steel, and combinations thereof.

The outer reliefs 23 may be formed directly from the raw sheet of material forming the tray 21 and in such case are formed of the same material as the tray 21. In other embodiments, the outer reliefs may be formed of a material different than that of the tray and may be added to the bottom side of the tray by any appropriate fixing means, such as screwing, gluing, fusing, or welding.

Figure 2:
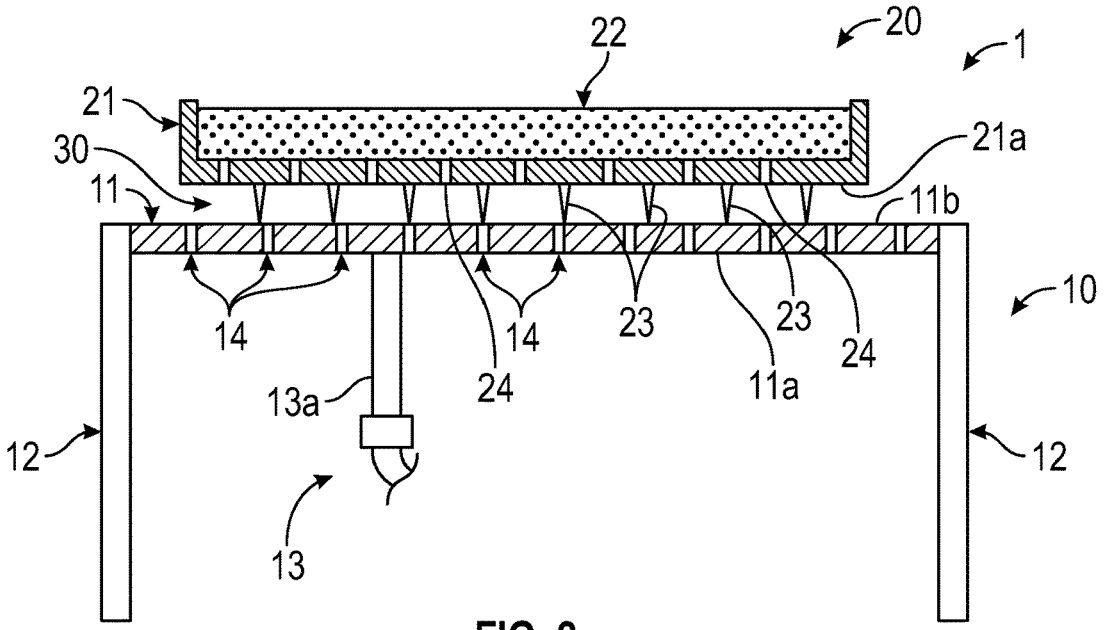
FIG. 2 is a cross section view of the vacuum hold down device of FIG. 1 with the porous support positioned on the perforated plate.
Figure 3:
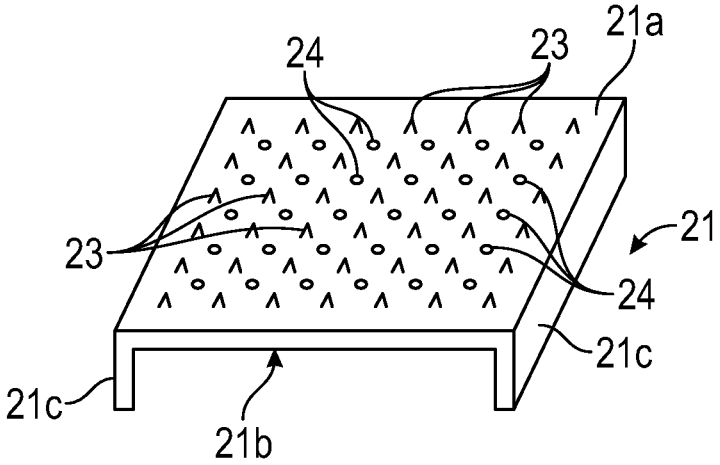
FIG. 3 is a bottom perspective view of the tray of the porous support of the device of FIGS. 1 and 2.
Figure 4:
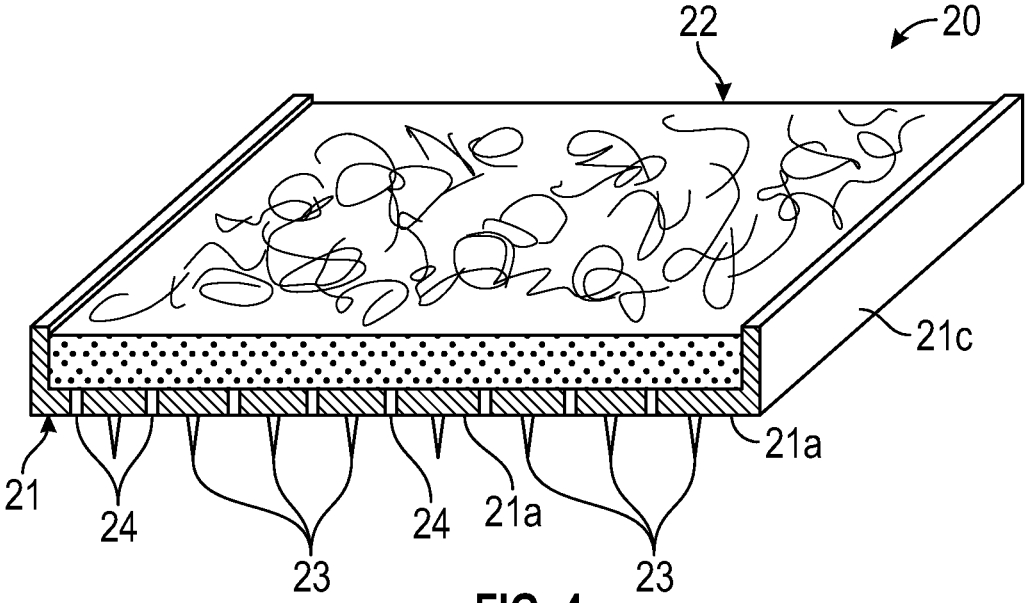
FIG. 4 is a perspective view of the porous support of the device of FIGS. 1 and 2.

With reference to FIGS. 1, 2 and 4, the blade penetrable porous structure 22 is fixed on the top side of the tray 21. The top side 21*b* of the tray is preferably smooth. However, in embodiments, the top side of the tray may be textured.

The blade penetrable porous structure 22 can be easily cut by a cutting device 40 usually used for cutting sheets of workpiece material such as textile. The cutting device 40 may for example be an elongated blade 41 (see FIG. 7) or a cutter. The penetrable porous structure 22 is intended to provide support for a sheet of workpiece material 100 to be cut and its porosity should allow the air from the vacuum system 13 to pass therethrough. The penetrable porous structure 22 may be formed of a foam plastic with open cells, like for example a low density cellular polyethylene or polypropylene material.

The thickness of the porous structure 22 is preferably greater than the vertical distance on which the blade or cutter is intended to penetrate in order to perform an accurate and efficient cutting of the sheet of workpiece material 100, so that the blade or cutter does not contact the perforated tray 21.

The porous structure 22 is fixed to the top side 21*b* of the tray 21 in a permanent way. The porous structure 22 is for example glued to the top side 21*b* of the tray via discrete points of glue, in order not to close the traversing holes 24 of the perforated tray 21. Whatever means used for permanently fixing the porous structure 22 to the top side 21*b* of the perforated tray 21, care should be taken not to close the traversing holes 24 of the tray 21 during the fixing operation.

As shown on FIGS. 1-3, the perforated tray 21 may be provided with side walls 21*c*, the height of which being slightly greater than the thickness of the porous structure 22 fixed to the tray 21. Anyway, with the porous structure 22 being fixed to the top side 21*b* of the tray 21, such side walls 21*c* may be optional. In embodiments not shown, the perforated tray 21 is free of any side walls 21*c*.

With reference to FIG. 2, the porous support 20 may be simply laid on the top side 11*b* of the perforated plate 11 of the table 10 of the vacuum hold down device 1. As shown in FIG. 2, the outer reliefs 23 face the top side 11*b* of the perforated plate 11, thereby creating a space 30 between the top side 11*b* of the perforated plate 11 and the bottom side 21*a* of the tray 21. This space 30 allows the airflow generated by the vacuum system 13 to pass therethrough when the vacuum system 13 is operated.

Figure 5:
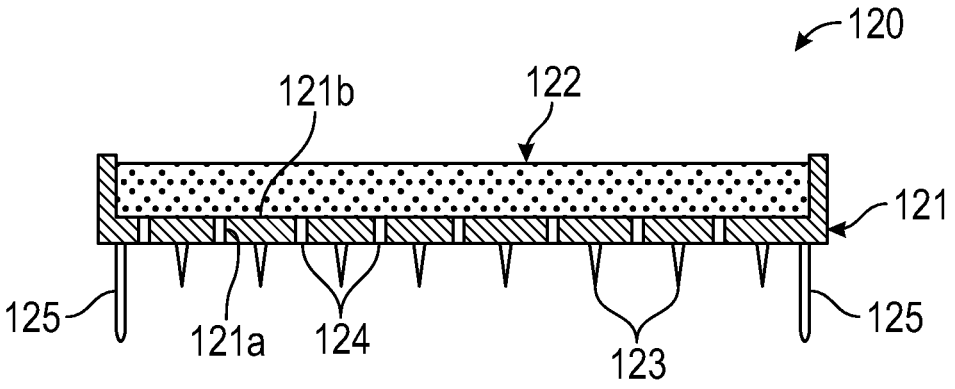
FIG. 5 is a cross section view of another embodiment of a porous support of the invention.
Figure 6:
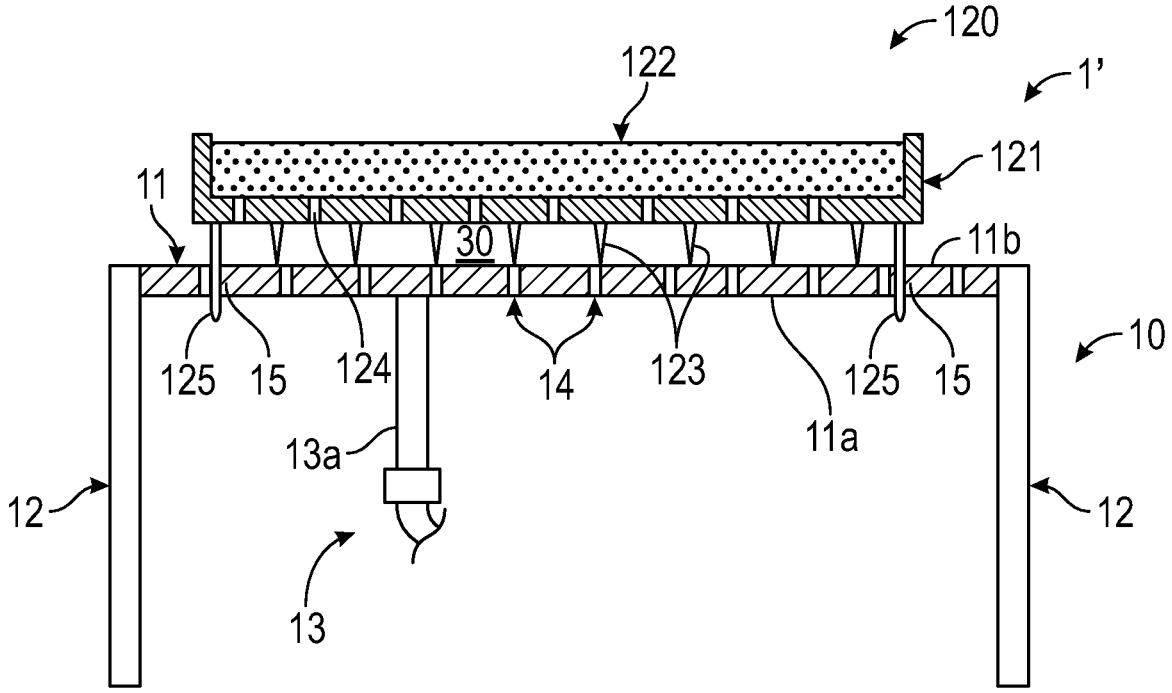
FIG. 6 is a cross section view of a vacuum hold down device of the invention with the porous support of FIG. 5 positioned on the perforated plate.

With reference to FIGS. 5 and 6, a vacuum hold down device 1' having another embodiment of a porous support of the invention, similar to that of FIGS. 1-4, is shown. The porous support 120 of FIGS. 5 and 6 comprises a penetrable porous structure 122 and a tray 121 with outer reliefs 123 and traversing holes 124 similar to the porous support 20 of FIGS. 1-4. The porous support 120 of FIGS. 5-6 is further provided with screws 125 intended to be screwed in corresponding threaded holes 15 provided in the perforated plate 11 of the table 10 of the vacuum hold down device 1. For example four screws 125 are provided (only two of them being visible on FIGS. 5 and 6). Such screws 125 form fixing means for temporarily fixing the porous support 121 to the perforated plate 11.

Figure 7:
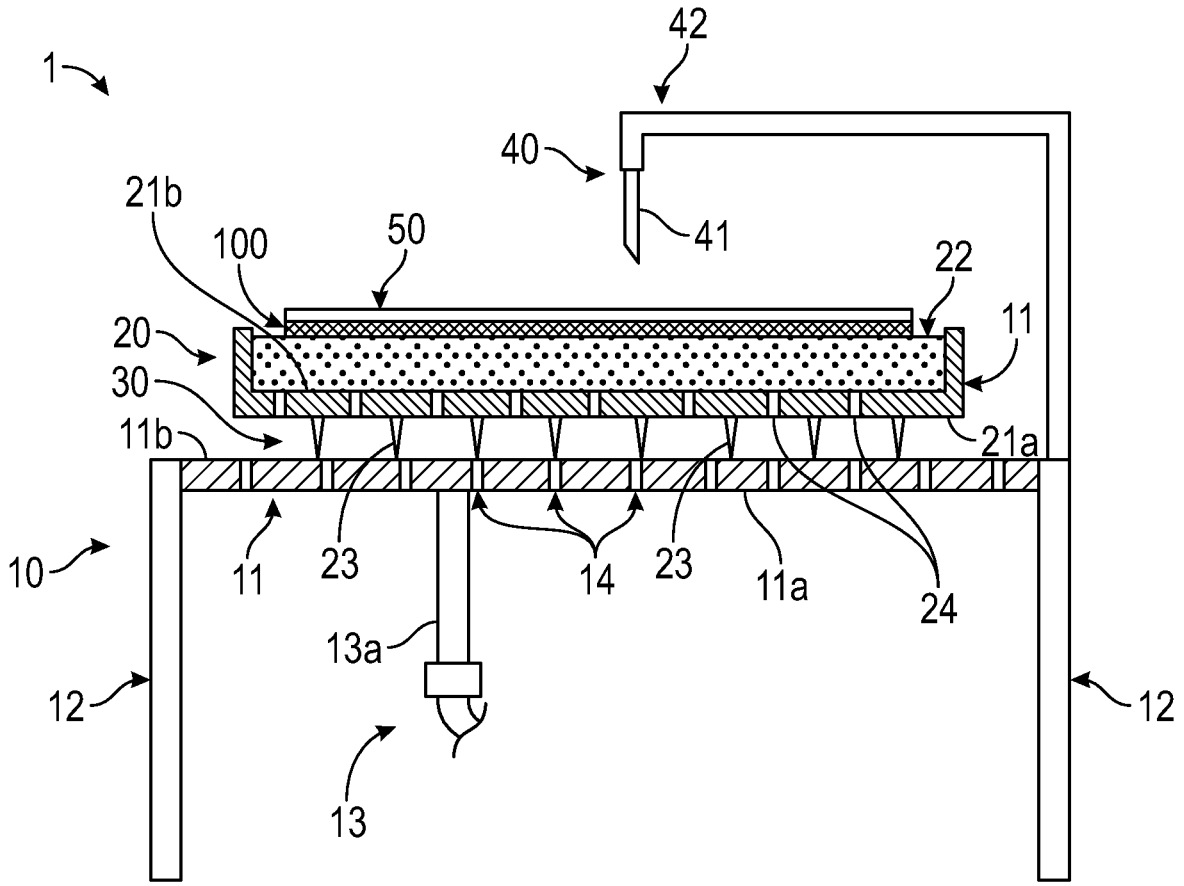
FIG. 7 is a cross section view of the device of FIG. 2 during the step of cutting of a sheet of workpiece material.

With reference to FIG. 7 is shown the vacuum hold down device 1 of FIGS. 1-4, further provided with the cutting device 40 and ready to be operated.

The sheet of workpiece material 100 has been laid on top of the porous structure 22 of the porous support 20.

The sheet of workpiece material 100 may be porous or non porous such as a fabric layup, textile, knits, woven, nonwovens, . . .

A film 50, or thin flexible panel, of substantially air-impervious material has been provided for substantially covering the exposed surface of the sheet of workpiece material 100. For example, the film 50 may be a plastic film, such as a polyethylene film. The film 50 cooperates with the vacuum system 13 connected to the bottom side 11*a* of the perforated plate 11 in order to apply compacting force thereto. The film 50 is preferably of a size allowing it to be spread over the entire exposed surface of the sheet of workpiece material 100 to be cut, such as a textile. When the vacuum system 13 is applied and the cutting step proceeds, the film 50 holds down the sheet of workpiece material 50 to the porous support 20 and maintains it firmly in position, regardless from the lateral forces applied on the sheet of workpiece material 100 by the movements of the cutting device 40.

The cutting device 40 comprises the elongated blade 41, supported by a movable carriage 42 capable of traversing the surface of the table 10 in two coordinate directions, for example in response to position signals supplied by a controller. Alternatively, the movable carriage 42 could be operated manually. The blade 41 is supported for vertically reciprocating movement in cutting engagement with the sheet of workpiece material 100, e.g; a textile, and film 50. The blade 41 is movable along any line, straight or curved, as required by the final shape desired for the cut textile.

At the beginning of the cutting step, the blade 41 is elevated with respect to the film 50, as shown on FIG. 7, so as to be moved to a starting position. The blade 41 is then lowered to penetrate the film 50, the sheet of workpiece material 100, such as a textile, and part of the penetrable porous structure 22 of the porous support 20, and the cutting step proceeds. The porous structure 22 has a thickness greater than the distance on which the blade 41 may be lowered so that the blade 41 never contacts the top side 21*b* of the perforated tray 21 of the porous support 20. The blade 41 is adjusted to penetrate the porous structure 22 so as to ensure efficient and accurate cutting of the sheet of workpiece material 100 such as a textile.

The removably positionable porous support 20 of the invention allows providing a plurality of porous supports to be used in combination with the table 10. In particular, a first porous support of the invention may be dedicated to the cutting of a first specific textile, having either a specific color, nature, density. A second porous support of the invention may be dedicated to the cutting of a second specific textile, having either a specific color, nature, density, different from that of the first specific textile. In case where these textiles are intended to be used for the manufacture of implantable prosthesis, it is not acceptable that bits of the first specific textile, produced by the cutting step, be mixed to the second specific textile. The porous supports of the invention allow preserving the quality of the cut textiles.

Indeed, once the cutting operations relative to a first specific textile are over and proceeding to the cutting operations relative to a second specific textile is contemplated, the process for replacing the first porous support dedicated to the cutting of a first specific textile by a second porous support dedicated to the cutting of a second specific textile may be performed very easily and in a limited time. Actually, such a process comprises the simple following steps:

i) removing the first porous support, and ii) positioning the second porous support on the top side of the perforated plate, with the outer reliefs of the perforated tray of the second porous support facing the top side of the perforated plate.

In case the positioning of the first and second porous supports requires that these porous supports be simply laid on the top side of the perforated plate, such operations may be performed in a very limited time. In the same manner, in such a case, the removal of the first porous support may also be performed very rapidly.

In embodiments where the device comprises screwing means, for example screws 125, for temporarily fixing a porous support to the top side of the perforated plate, step i) comprises unscrewing the first porous support from said perforated plate and step ii) comprises screwing said second porous support on said perforated plate. In this embodiment also, the various operations to be performed may be completed very rapidly. In particular, these operations may be completed significantly more rapidly than in devices of the prior art where the porous bed to be removed must be unglued from the perforated plate and the porous bed to be installed must be glued to the perforated plate.

As a result, the removably positionable porous supports and vacuum hold down device of the invention allow gaining significant time during the maintenance operations of the device. The time necessary for the maintenance of the vacuum hold down device is therefore significantly lowered and the device may be used for production for a longer time. The rate of the production line is therefore increased.

What is claimed is:

1. A process for manufacturing cut textiles comprising positioning a first porous support on a top side of a perforated plate of a vacuum hold down device, the first porous support including a first perforated tray provided on a first bottom side with first outer reliefs facing the top side of the perforated plate and on a first top side with a blade penetrable first porous structure, the first porous structure including a first surgical textile laid thereon, cutting at least the first surgical textile with a cutting device, removing the first porous support as a unit from the perforated plate of the vacuum hold device, positioning a second porous support on the top side of the perforated plate of the vacuum hold down device, the second porous support including a second perforated tray provided on a second bottom side with second outer reliefs facing the top side of the perforated plate and on a second top side with a second blade penetrable porous structure including a second surgical textile laid thereon, and cutting at least the second surgical textile with the cutting device.

2. The process of claim 1, further comprising reducing pressure on a bottom side of the perforated plate via a vacuum system of the vacuum hold down device, prior to cutting at least the first surgical textile.

3. The process of claim 1, further comprising reducing pressure on a bottom side of the perforated plate via a vacuum system of the vacuum hold down device, prior to cutting at least the second surgical textile.

4. The process of claim 1, covering the first surgical textile with an air impervious film prior to cutting at least the first surgical textile, wherein the film cooperates with the vacuum system connected to the bottom side of the perforated plate to apply a compacting force to the first surgical textile.

5. The process of claim 1, covering the second surgical textile with an air impervious film prior to cutting at least the second surgical textile, wherein the film cooperates with the vacuum system connected to the bottom side of the perforated plate to apply a compacting force to the second surgical textile.

6. The process of claim 1, wherein the first and second surgical textiles are different types of surgical textiles.

7. The process of claim 6, wherein the first and second surgical textiles are different colors.

8. The process of claim 6, wherein the first and second surgical textiles have different densities.

9. The process of claim 1, wherein the first outer reliefs are configured so as to create a space between the top side of the perforated plate and the first perforated tray for allowing passage of airflow from the vacuum system, when the first porous support is positioned on the top side of the perforated plate, with the first outer reliefs facing the top side.

10. The process of claim 1, wherein the second outer reliefs are configured so as to create a space between the top side of the perforated plate and the second perforated tray for allowing passage of airflow from the vacuum system, when the second porous support is positioned on the top side of the perforated plate, with the second outer reliefs facing the top side.

11. The process of claim 1, further comprising temporarily fixing the first porous support to the perforated plate by screwing first screws extending from a bottom side of the first perforated tray into threaded holes provided in the top side of the perforated plate.

12. The process of claim 11, further comprising temporarily fixing the second porous support to the perforated plate by screwing second screws extending from a bottom side of the second perforated tray into the threaded holes provided in the top side of the perforated plate.

13. The process of claim 1, wherein cutting the first surgical textile further comprises cutting the first film and the first porous structure.

14. The process of claim 1, wherein cutting the second surgical textile further comprises cutting the second film and the second porous structure.

15. The process of claim 1, wherein the first perforated tray includes a first pair of sidewalls extending upwardly from opposite ends of the top side of the first perforated tray and having a height which is greater than a thickness of the first blade penetrable porous structure.

16. The process of claim 1, wherein the second perforated tray includes a second pair of sidewalls extending upwardly from opposite ends of the top side of the second perforated tray and having a height which is greater than a thickness of the second blade penetrable porous structure.

17. The process of claim 1, wherein the cutting device is supported by a movable carriage.

18. The process of claim 1, wherein a thickness of the first blade penetrable porous structure is greater than a vertical distance on which the cutting device is configured to penetrate to cut the first surgical textile and the cutting device does not contact the first perforated tray.

19. The process of claim 1, wherein a thickness of the second blade penetrable porous structure is greater than a vertical distance on which the cutting device is configured to penetrate to cut the second surgical textile and the cutting device does not contact the second perforated tray.

* * * * *